US009806442B2

(12) United States Patent
Geske

(10) Patent No.: US 9,806,442 B2
(45) Date of Patent: Oct. 31, 2017

(54) PLUG CONNECTION DEVICE

(71) Applicant: PHOENIX CONTACT GMBH & CO. KG, Blomberg (DE)

(72) Inventor: Ralf Geske, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/780,560

(22) PCT Filed: Apr. 3, 2014

(86) PCT No.: PCT/EP2014/056746
§ 371 (c)(1),
(2) Date: Sep. 28, 2015

(87) PCT Pub. No.: WO2014/161965
PCT Pub. Date: Oct. 9, 2014

(65) Prior Publication Data

US 2016/0056552 A1 Feb. 25, 2016

(30) Foreign Application Priority Data

Apr. 5, 2013 (DE) ..... 10 2013 103 446

(51) Int. Cl.
*H01R 24/00* (2011.01)
*H01R 12/55* (2011.01)
(Continued)

(52) U.S. Cl.
CPC ..... *H01R 12/55* (2013.01); *H01R 4/48* (2013.01); *H01R 12/716* (2013.01);
(Continued)

(58) Field of Classification Search
CPC ..... H01R 12/55; H01R 4/48
(Continued)

(56) References Cited

U.S. PATENT DOCUMENTS 3,596,235 A 7/1971 Teurlings
4,668,040 A 5/1987 Matsuzaki et al.
(Continued)

FOREIGN PATENT DOCUMENTS

CN 201966439 U 9/2011
DE 19942754 A1 3/2000
(Continued)

OTHER PUBLICATIONS

Japanese Office Action, dated Oct. 3, 2016, Japanese Patent Office, pp. 1-4.

*Primary Examiner* — Tho D Ta
*Assistant Examiner* — Nader Alhawamdeh
(74) *Attorney, Agent, or Firm* — Leydig, Voit & Mayer, Ltd.

(57) ABSTRACT

A plug connection device for connecting a cable having at least one core to a circuit board includes a connector which can be connected to the core of the cable, and a base strip which can be connected to the circuit board The base strip includes a soldering pin which can be electrically connected to the core of the cable in a plug-in region by placing the connector onto the base strip and which can be soldered to the circuit board in a soldering region in order to produce a conductive connection. The soldering region of the soldering pin includes a plurality of contact zones such that the base strip can be connected to the circuit board in different orientations.

17 Claims, 11 Drawing Sheets

(51) Int. Cl.
*H01R 12/71* (2011.01)
*H01R 4/48* (2006.01)
*H01R 12/75* (2011.01)
*H01R 13/627* (2006.01)

(52) U.S. Cl.
CPC ..... *H01R 4/4827* (2013.01); *H01R 12/75* (2013.01); *H01R 13/6278* (2013.01)

(58) Field of Classification Search
USPC ..... 439/660
See application file for complete search history.

(56) References Cited

U.S. PATENT DOCUMENTS 5,993,270 A * 11/1999 Geske ..... H01R 4/4845 439/835
6,146,181 A * 11/2000 Plaza ..... H01R 13/6273 439/357
6,247,955 B1 6/2001 Yoshida et al.
7,942,689 B1 * 5/2011 Huss, Jr. ..... H01R 4/2404 439/409
D640,207 S * 6/2011 Huss, Jr. ..... D13/147
D649,119 S * 11/2011 Huss, Jr. ..... D13/147
2003/0114037 A1 6/2003 Abe
2005/0186813 A1 8/2005 Lohr
2008/0311767 A1 12/2008 Weber
2010/0248549 A1 * 9/2010 Lim ..... H01R 13/6581 439/626
2013/0023144 A1 1/2013 Song et al.
2013/0178080 A1 * 7/2013 Lettmann ..... H01R 12/51 439/83
2014/0065887 A1 * 3/2014 Kida ..... H01R 13/46 439/629

FOREIGN PATENT DOCUMENTS

DE 10031428 A1 1/2002
DE 102004009071 A1 9/2005
DE 102006027014 A1 12/2007
EP 1037317 A2 9/2000
EP 1309036 A1 5/2003
EP 1357640 A2 10/2003
JP 53029835 B 8/1978
JP S 59192282 U 12/1984
JP 61023283 U 2/1986
JP 62020481 U 2/1987
JP 2000268905 A 9/2000
JP 2003317822 A 11/2003

* cited by examiner

PLUG CONNECTION DEVICE

CROSS REFERENCE TO RELATED APPLICATIONS

This application is a U.S. National Stage Application under 35 U.S.C. §371 of International Application No. PCT/EP2014/056746 filed on Apr. 3, 2014, and claims benefit to German Patent Application No.10 2013 103 446.2 filed on Apr 5, 2013. The International Application was published in German on Oct. 9, 2014 as WO 2014/161965 A1 under PCT Article 21(2).

FIELD

The invention relates to a plug connection device for connecting a cable to a circuit board.

BACKGROUND

Producing a connection of a cable to a circuit board is a problem which frequently arises when installing electrical systems, when assembling electronic devices or when connecting electronic circuits to external components such as sensors.

This problem is usually solved by using a plug connection device, a number of different plug connection devices being known on account of a number of different requirements.

When developing a plug connection device, in addition to a number of parameters such as the number of contacts, the electrical load carrying capacity (current, voltage), the mechanical load carrying capacity, the amount of plug clearance, the IP protection class, insulation, etc., the structural size and the direction in which the plug connection is to be opened or closed in relation to the circuit board, are also important.

Often, limited spatial conditions, such as when constructing compact electronic devices, permit only a few degrees of mechanical freedom. The direction in which a plug connection device is to be actuated is therefore often predetermined.

In the prior art, plug connection devices have therefore previously been provided in different variants for different plug-in directions but having an otherwise almost identical configuration.

A designer has access to various plug connection devices, depending on the installation situation, for example to variants which are to be actuated either horizontally or vertically relative to the circuit board. Depending on the required actuation direction, a designer turns to different products in different situations, the manufacturers in turn offering different products accordingly. A plurality of variants of a component results in significantly higher costs in the chain from manufacture to use than would result from a universally applicable component.

SUMMARY

In an embodiment, a plug connection device for connecting a cable having at least one core to a circuit board is provided. The plug connection device includes a connector which can be connected to the core of the cable, and a base strip which can be connected to the circuit board. The base strip includes a soldering pin which can be electrically connected to the core of the cable in a plug-in region by placing the connector onto the base strip and which can be soldered to the circuit board in a soldering region in order to produce a conductive connection. The soldering region of the soldering pin includes a plurality of contact zones such that the base strip can be connected to the circuit board in different orientations.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
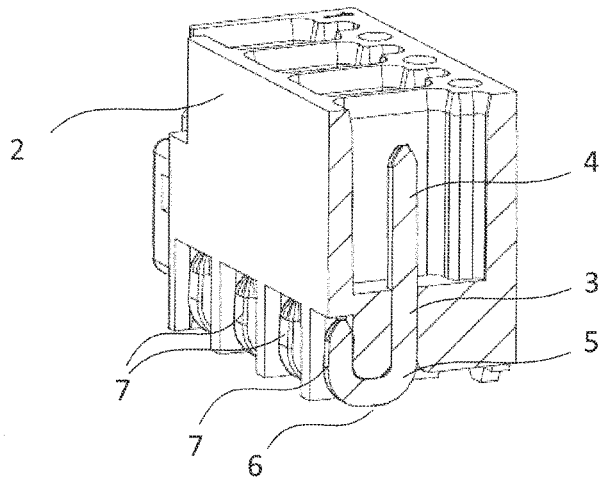
FIG. 1 is a perspective view of one embodiment of a base strip of a plug connection device according to an embodiment of the invention.

In an embodiment, the invention provides a plug connection device which permits a wide field of application, meaning that the range of variants can be reduced.

Accordingly, according to an embodiment of the invention, a plug connection device for connecting a cable comprising at least one core to a circuit board is provided, comprising a connector which can be connected to the core of the cable and a base strip which can be connected to the circuit board, the base strip comprising at least one soldering pin which can be electrically connected to the core of the cable in a plug-in region by placing the connector onto the base strip and which can be soldered to the circuit board in a soldering region in a contact zone in order to produce a conductive connection, characterised in that the soldering region of the soldering pin comprises a plurality of contact zones such that the base strip can be connected to the circuit board in different orientations corresponding to a respective contact zone.

An advantage of this solution consists in the fact that, since the base strip can be connected to the base strip in different orientations, different actuation directions—depending on the respective orientation of the base strip—for opening and closing the plug connection device are made possible. The field of application of the plug connection device is thereby increased, meaning that the range of variants can be reduced.

In principle, there are many options for the orientation of the contact zones to one another. Advantageously, however, the contact zones of the soldering pin are arranged at right angles to each other such that the base strip can be connected to the circuit board in two orientations which are at right angles to each other. In this case, a contact zone of a soldering pin is to be understood as the surface with which it can come into contact with the circuit board.

Depending on the assembly technique used, for example SMD (surface mounted device) or THT (through-hole technology) and THR (through-hole reflow), the contact zone preferably consists of a planar support surface or a cylindrical peripheral surface which encases the soldering pin in part.

The contact zones are at right angles to each other when the surface vectors of the surfaces with which the soldering pin can come into contact with the circuit board form a right angle. An embodiment of this kind permits the two actuation directions, which frequently occur in practice, perpendicular or vertical to the circuit board.

Advantageously, the soldering pin can be designed in the shape of a "J", the bottom arch of the "J"-shaped soldering pin forming a first contact zone and the short shaft of the "J"-shaped soldering pin forming a second contact zone. Advantageously again, the plug-in region of the soldering pin is formed by the long shaft of the "J"-shaped soldering pin.

A design of this kind makes it possible for the base strip to be produced in a simple and compact manner. In this case, the soldering pin can be formed from a piece of wire which is fitted into the base strip so as to be directly contactable by the connector in the plug-in region and so as to engage in a recess on the surface of the base strip in the soldering region.

Since the soldering region of the soldering pin engages in a recess in the base strip, the soldering pin remains contactable, a flush surface between the soldering pin and the base strip at the same time providing a large support surface of the base strip on the circuit board which improves the mechanical load carrying capacity.

An embodiment of this kind is preferably suitable for an SMD assembly technique.

In another advantageous embodiment, the soldering pin is designed in the shape of a "T", a first leg of the "T"-shaped soldering pin forming a first contact zone and a second leg of the "T"-shaped soldering pin forming a second contact zone. Further advantageously, in this case a third leg of the "T"-shaped soldering pin forms the plug-in region of the soldering pin.

This embodiment also permits a simple and compact design of the base strip, it being possible to produce the "T"-shaped soldering pins in a first manufacturing step by folding a wire or by stamping, and it being possible to coat the "T"-shaped soldering pins in a second manufacturing step with a plastics material in order to manufacture the base strip.

In this embodiment too, a leg of the "T"-shaped soldering pin can be fitted into the base strip so as to be directly contactable by the connector in the plug-in region. The two other legs of the soldering pin project laterally out of the base strip and are capable of mounting the base strip in different orientations on a circuit board. In the process, the respective soldering pin pushes through the circuit board via a contact hole so as to be able to be soldered on the rear side.

An embodiment of this kind is preferably suitable for a THT or THR assembly technique.

Independently of a "T"-shaped soldering pin or a "J"-shaped soldering pin, the plug-in region of the soldering pin advantageously projects through the base strip so as to be connectable to the core of the cable by means of the connector. As a result, the soldering pin can fulfil the function both of a contact element on one side and of a plug element on the other side of the base strip.

Further advantageously, the base strip can be connected to the circuit board by means of a soldering anchor.

When the plug connection is actuated, mechanical forces can occur which act on the connection between the base strip and the circuit board. In an unfavourable case, this may lead to the base strip being severed from the circuit board. When using the SMD assembly technique, the base strip is soldered to conductor tracks present on the surface of the circuit board. If forces act strongly on the connection between the base strip and the circuit board, it is possible that the conductor tracks may be severed from the circuit board.

In order to mechanically strengthen the connection between the base strip and the circuit board, the base strip can therefore be connected to the circuit board by means of one or more soldering anchors which can be mounted on the sides of the base strip for example. Soldering anchors of this kind preferably penetrate through the circuit board via a hole or a through-opening so as to be able to be soldered on the rear side.

Advantageously, the base strip provides at least one receiving means for mounting a soldering anchor, the receiving means being configured such that the soldering anchor can be connected to the base strip in different orientations.

In this case, the receiving means may be an integral component of the base strip or may also be a separate component designed so as to be movable relative to the base strip. A base strip can therefore comprise receiving means at the ends thereof, which means are designed to be rotatable and, optionally, lockable in different positions such that the base strip can be oriented in different positions.

For connection to the circuit board by means of a soldering anchor, the base strip can advantageously comprise both a vertical and a horizontal through-opening capable of functioning as a receiving means for mounting the soldering anchor. In addition, the base strip can also comprise further through-openings, for example in steps of 45 degrees, in order to permit further positions. In this case, it is further advantageous for said openings to cross, so as to permit a compact design of the base strip.

Furthermore, in an embodiment, the invention provides a plug connection device which ensures secure fixing of the connector and the base strip in the plugged-in state, irrespective of the material of said device.

According to the invention, a plug connection device is therefore provided, comprising a connector and a base strip which can be mechanically and electrically contacted to one another in a predetermined plug-in direction by means of a plug connection, a latching tab and a latching lug, which can be latched to each other, being provided for mechanically fixing the plug connection device in the plugged-in state, characterised in that the latching tab is attached only at one side, and the bending axis thus formed on this side is at an angle of less than 45° to the plug-in direction.

In an embodiment, there is just a small angle between the plug-in direction and the bending axis, specifically in any case an angle which is less than 45°. In this case, the bending axis denotes a fictitious axis about which the latching tab is bent outwards during the plugging process on account of the latching lug which comes into contact with the latching tab. In fact, frequently in practice no linear bending axis will occur, but rather bending of the latching tab over a certain extended portion. However, for the sake of simplicity, the explanation of the invention will refer to a bending axis which is also given a precisely defined orientation, so that it is possible to refer to an angle between the bending axis and the predetermined plug-in direction.

As described above, according to an embodiment of the invention, this angle can be small; an angle of less than 45° is suitable in principle. According to a preferred development of the invention, however, the angle is even smaller, preferably smaller than 10° , and very particularly preferably an angle of 0 is provided. This means that the bending axis extends in parallel with the plug-in direction.

In this context, it is further preferably provided for the latching lug to be arranged and configured in such a way that it comes into contact with the latching tab only at the edge of the free end thereof during the plugging process. Although according to the invention the latching lug can in principle be arranged as desired as long as it latches with the latching tab, this preferred embodiment has the following advantage:

If the latching lug comes into contact with the latching tab only at the edge, i.e. at the free end, thereof and urges it outwards at that point, the bending of the latching tab is also only such as is determined by the height of the latching lug. In the prior art, in which the insertion direction routinely extends perpendicularly to the bending axis, a small deflection of this kind is not possible. Specifically, the latching lug is guided far into the latching tab here such that substantially greater bending of the latching tab occurs as a result, i.e. the latching tab is bent much further upwards. Thus, according to the present preferred embodiment of the invention, it is possible to also use a relatively brittle material, such as LCP having a glass fibre content of 30%, for the plug connection device, in particular for the latching tab.

According to a preferred embodiment of the invention, an opening, arranged behind the latching tab, is further provided for latching the latching lug to the latching tab. The opening is preferably open towards the deflected end of the latching tab in this case. In addition, it is preferred for the end of the opening which is opposite the open end to be rounded, at least in part, at least in the direction of the latching tab, in the end thereof opposite the open end. This results in mechanical strengthening of the latching tab and can prevent severing of the latching tab.

Finally, it should be noted that the latching tab can in principle be provided on the connector and the latching lug can accordingly in principle be provided on the base strip. However, according to a preferred development of the invention, the latching tab is provided on the base strip and the latching lug is provided on the connector.

Furthermore, in an embodiment, the invention ensures simple and secure connection of an electrical conductor in the case of an electrical connecting device for connecting an electrical conductor, in particular in the case of a plug connection device as described above.

Thus, according to an embodiment of the invention, an electrical connecting device for connecting an electrical conductor, in particular a plug connection device as described above, is provided, comprising a housing, a connecting spring provided in the housing for electrically contacting the electrical conductor, a spring break contact, which can be actuated by means of a tool, for opening the spring, and a cable insertion funnel for inserting the electrical conductor in the direction of the connecting spring, the spring break contact and the cable insertion funnel being adjacent to each other, and the spring break contact comprising an actuation surface for the tool which is surrounded by a U-shaped wall.

Secure holding of the tool, for example a screwdriver, on the spring break contact is achieved in this manner since the U-shaped wall provides a stop for the tool on three sides. In this case, the fact that the spring break contact and the cable insertion funnel are adjacent to each other means that these two apparatuses are next to each other, but do not have to directly adjoin each other. Finally, the spring break contact is routinely provided in the vicinity of the cable insertion funnel since the spring break contact is provided for opening the spring which should come into contact with the conductor inserted in the conductor insertion funnel.

According to a preferred development of the invention, it is provided for the opening in the U-shaped wall to be on the side facing away from the cable insertion funnel This configuration makes it possible to ensure that the tool cannot slip and thus cover the cable insertion region above the cable insertion funnel Free access to this region is thus constantly ensured, thus even during the process of connecting the cable, without the tool being able to interfere.

In this case, according to a further preferred embodiment, it is provided for the actuation direction of the spring break contact and the insertion direction of the cable insertion funnel to extend in parallel with each other.

FIG. 1 is a perspective view of one embodiment of the base strip 2 of the plug connection device according to the invention. The embodiment comprises a soldering pin 3 (shown in section), a plug-in region 4 and a contact region 5. The plug-in region 4 is open and can be contacted by a connector. The soldering pin 3 is designed in the shape of a "J". In the contact region 5 thereof, the soldering pin 3 shown in section comprises the two contact zones 6 and 7. These contact zones 6 and 7 are at right angles to each other on different sides of the base strip 2 and in each case end flush with the lateral surfaces of the base strip 2. The contact surface 7 of four soldering pins 3 can be seen in the embodiment of FIG. 1. One soldering pin 3 in each case is provided for each core of a multi-core cable.

Figure 2:
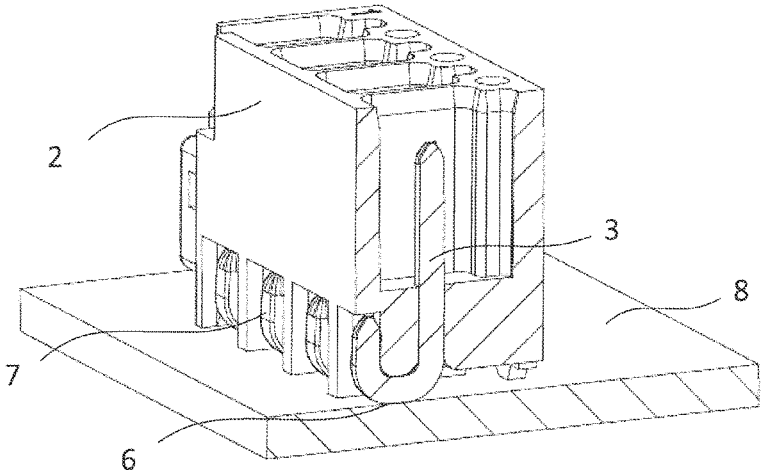
FIG. 2 shows the embodiment of FIG. 1 connected to a circuit board and oriented vertically.

FIG. 2 shows the embodiment of FIG. 1 connected to a circuit board and oriented vertically. The recesses in the base strip 2 receive the soldering pins 3 such that a flush base is formed for vertical orientation on the circuit board 8. The soldering pin 3 is in contact with the circuit board 8 in the contact zone 6 in such a way that said pin can be connected there in an electrically contacting manner to a conductor track (not shown) of the circuit board 8 using an SMD assembly technique.

Figure 3:
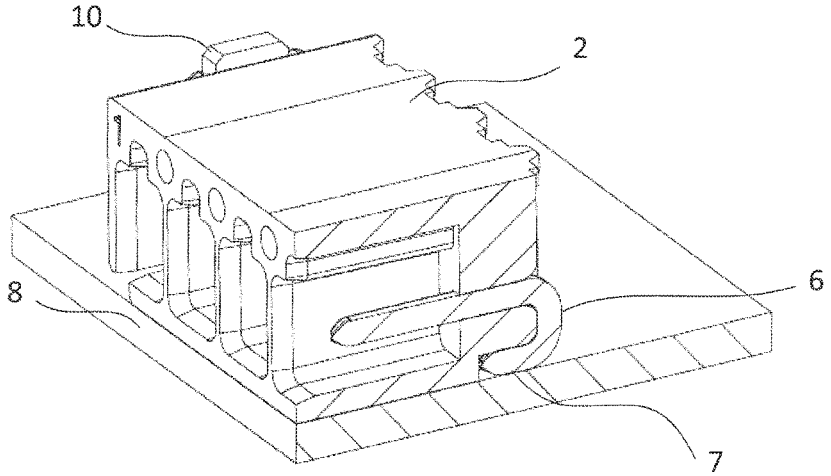
FIG. 3 shows the embodiment of FIG. 1 connected to a circuit board and oriented horizontally.

FIG. 3 shows the embodiment of FIG. 1 and FIG. 2 connected to a circuit board 8 and oriented horizontally. The recesses in the base strip 2 receive the soldering pins 3 such that a flush base is also formed for horizontal orientation on the circuit board 8. In this orientation, the soldering pin 3 is in contact with the circuit board in the contact zone 7 in such a way that said pin can be connected there in an electrically contacting manner to a conductor track (not shown) of the circuit board 8 using an SMD assembly technique.

Figure 4:
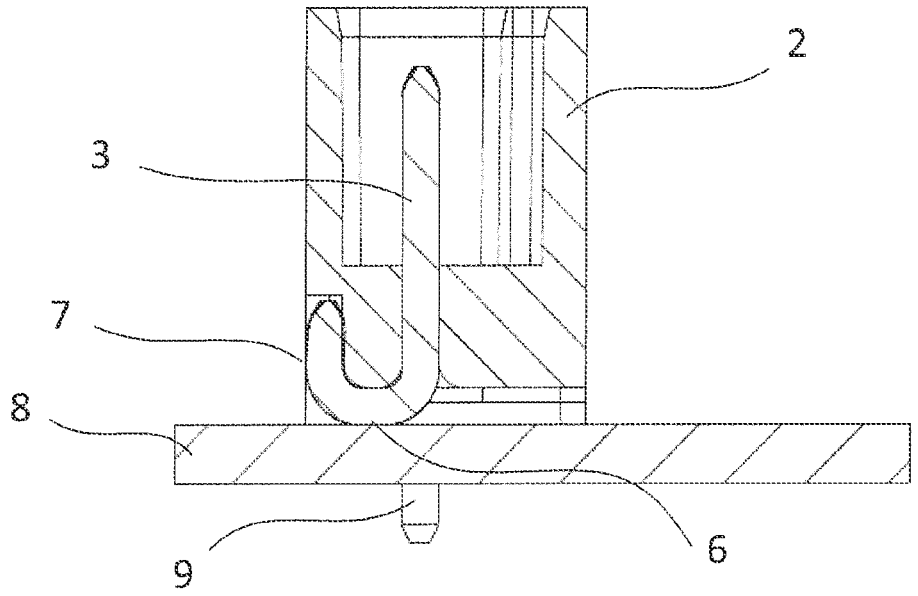
FIG. 4 is a sectional side view, parallel to the plug-in direction, of the embodiment of FIG. 2.

FIG. 4 is a sectional side view, parallel to the plug-in direction, of the embodiment of FIG. 2, the tip of an anchor shank 9 of a soldering anchor additionally being visible, which anchor shank mechanically fastens the base strip 2 to the circuit board 8 and is guided through a hole in the circuit board 8.

Figure 5:
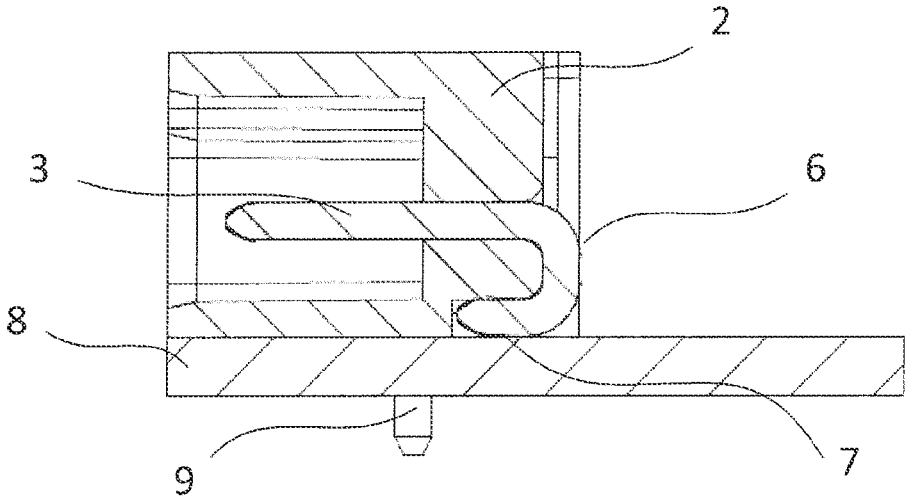
FIG. 5 is a sectional side view, parallel to the plug-in direction, of the embodiment of FIG. 3.

FIG. 5 is a sectional side view, in parallel with the plug-in direction, of the embodiment of FIG. 3, the tip of the anchor shank 9 of a soldering anchor being visible here too.

Figure 6:
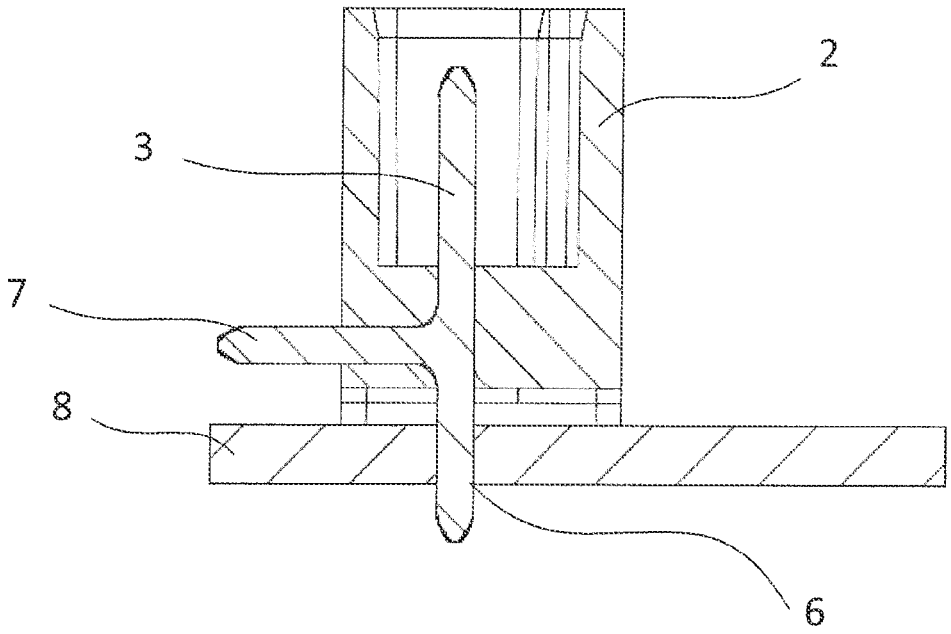
FIG. 6 is a sectional side view, parallel to the plug-in direction and shown assembled in a vertical orientation, of a second embodiment of a base strip of a plug connection device according to an embodiment of the invention.

FIG. 6 is a sectional side view, parallel to the plug-in direction and shown assembled in a vertical orientation, of a second embodiment of a base strip 2 of the plug connection device according to the invention. The embodiment comprises a soldering pin 3 (shown in section) comprising a plug-in region 4 and a contact region 5. The plug-in region 4 is open and can be contacted by a connector. The soldering pin 3 is in the shape of a "T", the contact region 5 of the soldering pin 3 is designed in the shape of an "L". In this contact region 5, the soldering pin 3 shown in section comprises the two contact zones 6 and 7. These zones are both in the portion of the "L"-shaped contact region in which the soldering pin 3 would come into contact with the circuit board 8 in the corresponding orientation of the base strip 2. In the orientation of FIG. 6, the soldering pin 3 comes into contact with the circuit board 8 in the contact zone 6. The contact zones 6 and 7 are at right angles to each other on different sides of the base strip 2 and are capable of pushing through the circuit board 8.

Figure 7:
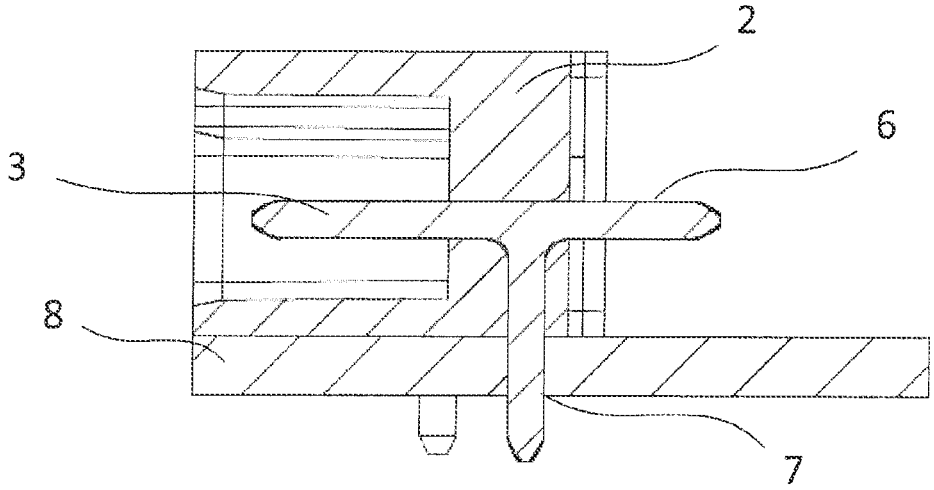
FIG. 7 shows the embodiment of FIG. 6 when assembled in a horizontal orientation.

FIG. 7 shows the embodiment of FIG. 6 when assembled in a horizontal orientation, the soldering pin 3 coming into contact with the circuit board 8 in the contact zone 7 in the orientation in FIG. 7. In addition, the tip of the anchor shank 9 of a soldering anchor is visible here, which shank is covered by the soldering pin 3 in the view in FIG. 6.

Figure 8:
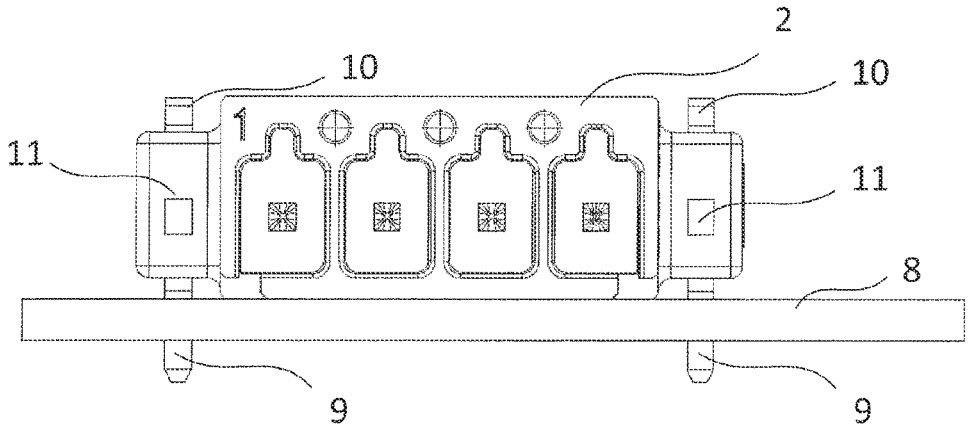
FIG. 8 shows an embodiment of the base strip of a plug connection device according to an embodiment of the invention in a horizontal orientation and viewed from the plug-in direction.

FIG. 8 shows an embodiment of the base strip 2 of the plug connection device according to the invention in a horizontal orientation and viewed from the plug-in direction. FIG. 8 shows, by way of example, a base strip 2 for connecting a multi-core cable to a circuit board 8, the tips of four soldering pins 3 for contacting a four-core cable being visible in the embodiment of FIG. 8. At the lateral ends transversely to the plug-in direction, the base strip 2 comprises receiving means 11 for receiving soldering anchors. The anchor shank 9 of a soldering anchor has a rectangular cross section and can be inserted in or guided through the rectangular through-openings 11. The two sides of the base strip 2 each comprise two of these openings, one for vertical orientation and one for horizontal orientation of the base strip 2. Only the free openings for vertical orientation can be seen clearly in FIG. 8. The openings for horizontal orientation are not visible from this perspective, and in addition are each filled by an anchor shank of a soldering anchor 9, which shank in each case penetrates both the opening in the base strip 2 and the circuit board 8. The arms of the anchor head 10 of the soldering anchor hold the base strip 2 on the circuit board 8.

Figure 9:
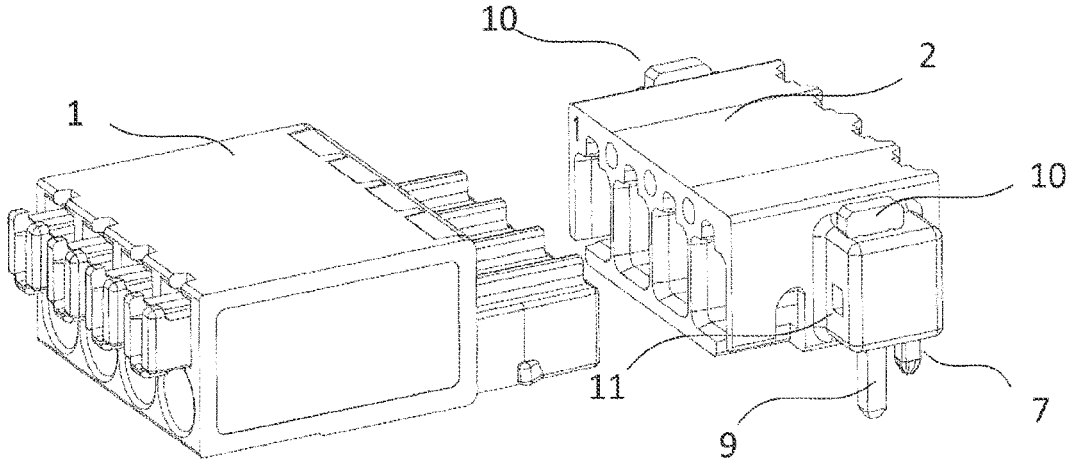
FIG. 9 shows an embodiment of a plug connection device according to an embodiment of the invention in the open position.

FIG. 9 shows an embodiment of the plug connection device according to the invention in the open position. In addition, the anchor shank 9 and the anchor head 10 of the soldering anchor mounted on both sides are visible in the perspective view.

Figure 10:
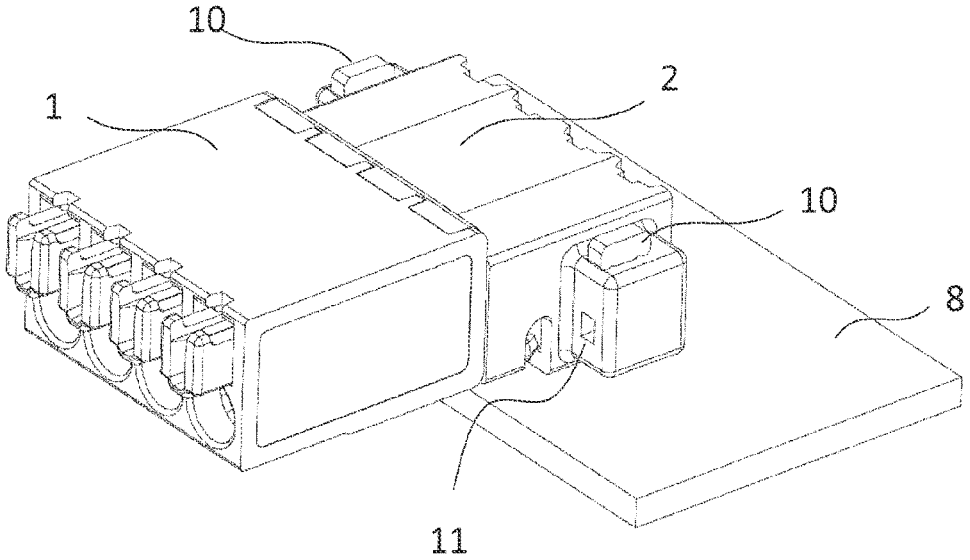
FIG. 10 shows the embodiment of FIG. 9 in the closed position.

FIG. 10 shows the embodiment of FIG. 9 in the closed position and when assembled in a horizontal orientation on a circuit board 8.

Figure 11:
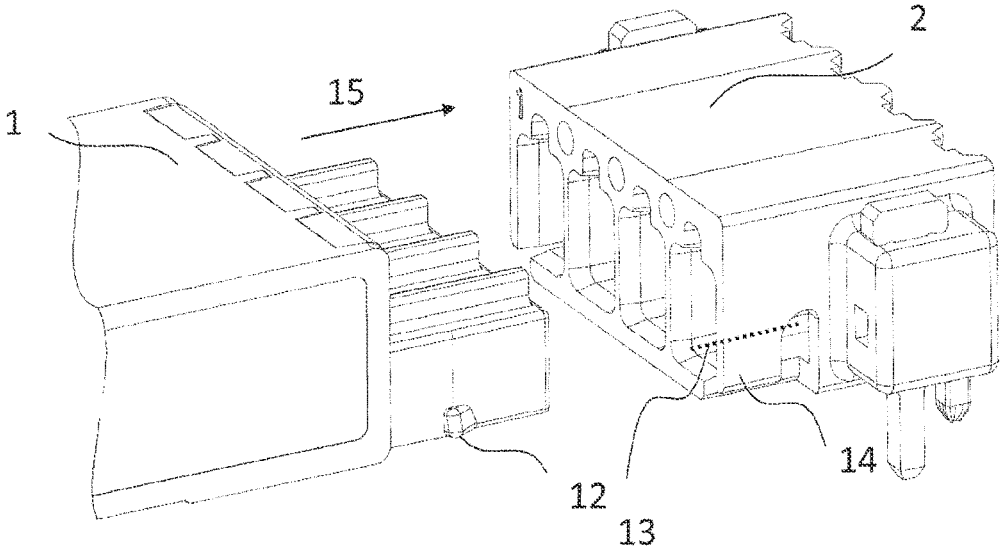
FIG. 11 shows the embodiment of FIG. 9 in the unplugged state and provides greater detail regarding the latching lug and latching tab.
Figure 12:
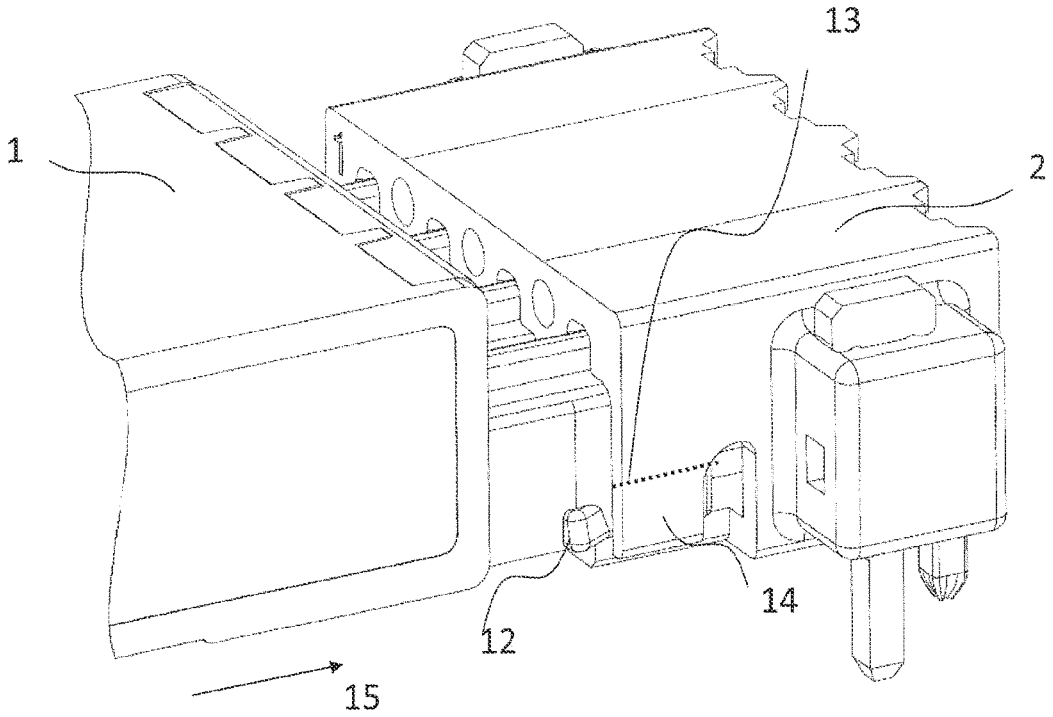
FIG. 12 shows the embodiment of FIG. 11 during the plugging process.
Figure 13:
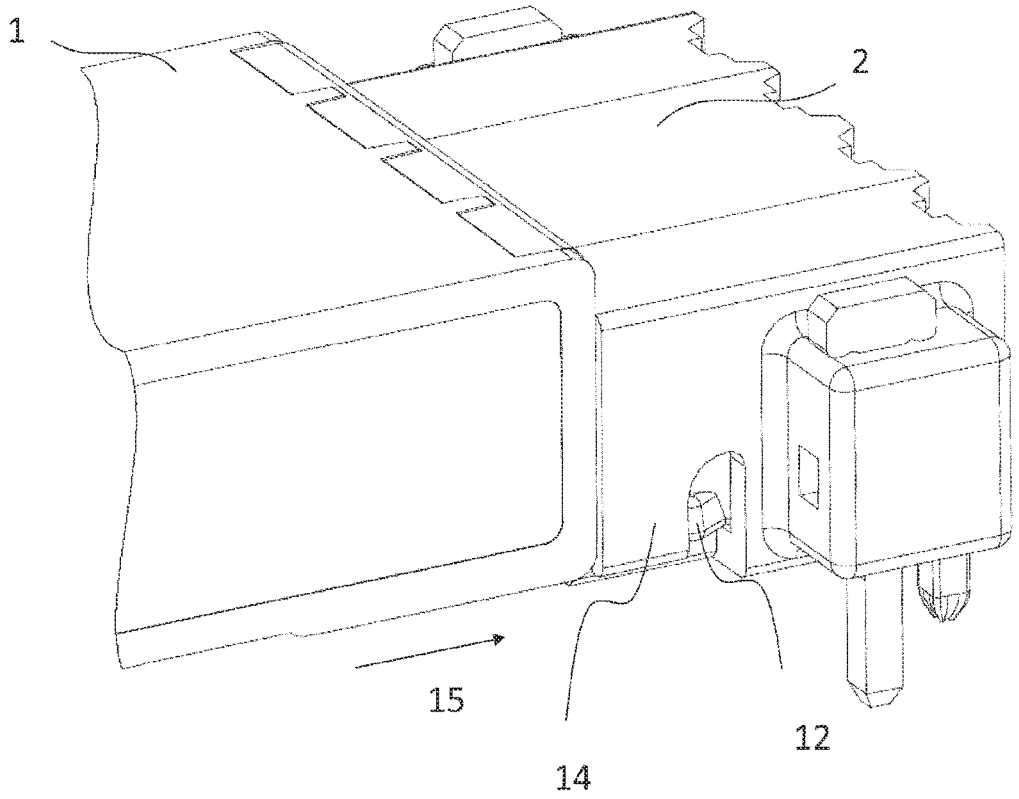
FIG. 13 shows the embodiment of FIGS. 11 and 12 in the plugged-in state.

Finally, FIGS. 11, 12 and 13 show how the connector 1 and the base strip 2 are mechanically fixed to each other. For this purpose, the connector 1 comprises, at least on one side, preferably on both sides, a latching lug 12 which can latch into an opening behind a latching tab 14 fastened to the base strip 2. This latched connection is distinctive in that the bending axis 13, shown by a dotted line in FIG. 12, about which the latching tab 14 is bent outwards, extends in parallel with the plug-in direction 15 shown in the same figure. As set out in detail above, this means that only slight upward bending of the latching tab is required, with the result that the connector 1 and the base strip 2, and in particular the latching tab 14, can also be produced from a relatively brittle material without fear of the material breaking.

Figure 14:
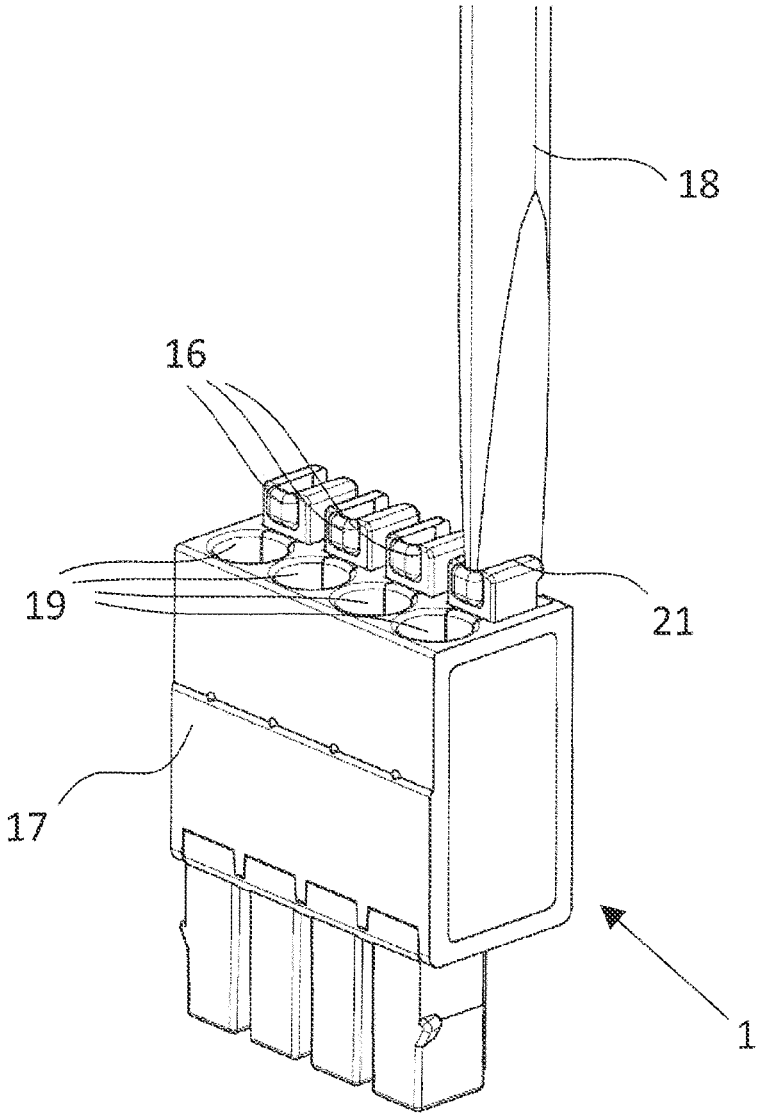
FIG. 14 is a perspective view of the already shown connector together with the spring break contact thereof which can be actuated by a tool.
Figure 15:
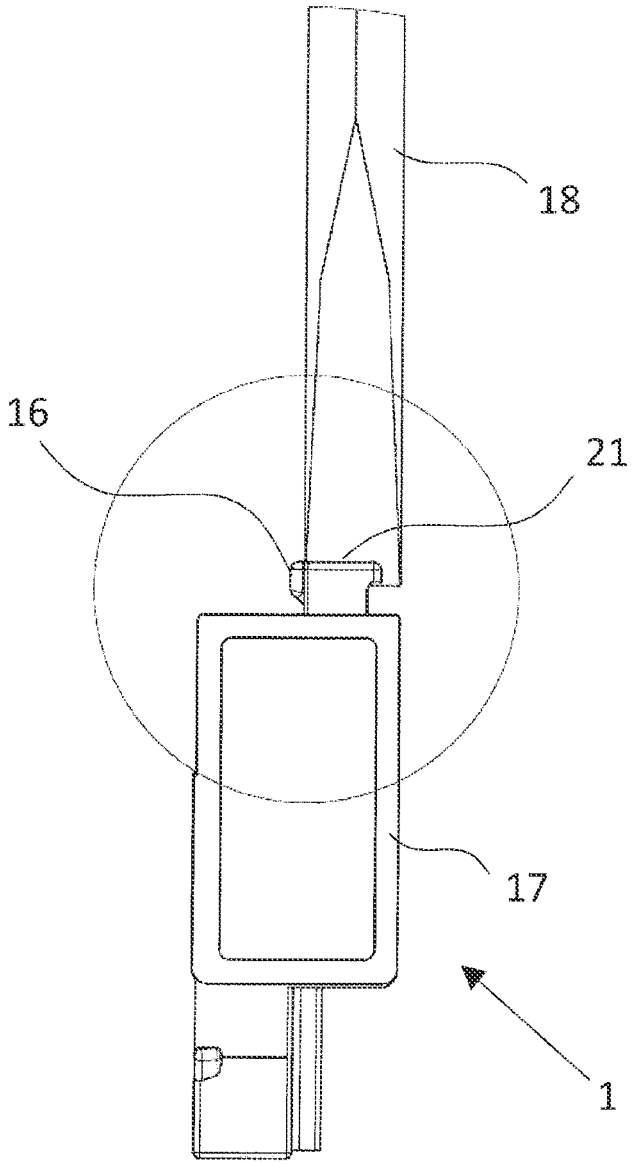
FIG. 15 is a side view of the connector of FIG. 14.
Figure 16:
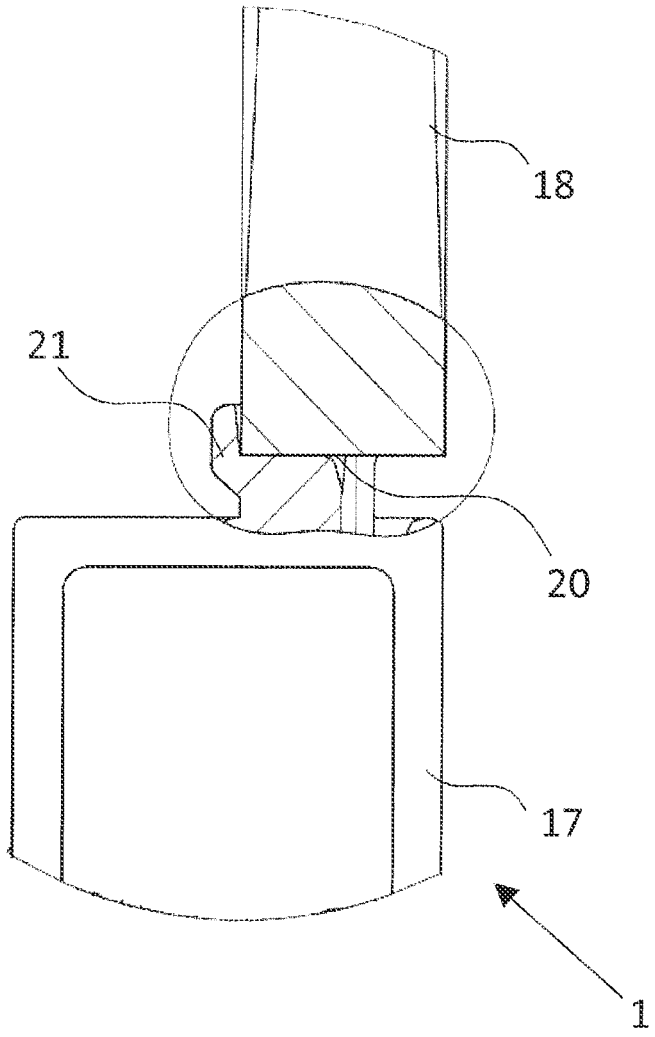
FIG. 16 is a sectional view of part of the connector of FIGS. 14 and 15.

Finally, FIGS. 14, 15 and 16 show in detail how spring break contacts 16 provided in the connector 1 are configured according to a preferred embodiment of the invention.

The connector 1 comprises a housing 17 and connecting springs, for electrically contacting electrical conductors, which are provided in the housing 17 and are not shown further. The spring break contacts 16 can be actuated by a tool 18, in this case a screwdriver, in order to open the respective connecting spring. One conductor can be inserted in the cable insertion funnel 19 in each case, and the conductor can thus be guided to the respective connecting spring. The actuation direction of a respective spring break contact 16 and the insertion direction of an associated cable insertion funnel 19 extend in parallel with each other.

As can be seen in particular in FIG. 14, the spring break contacts 16 and the associated cable insertion funnels 19 are adjacent to one another. The spring break contacts 16 each comprise an actuation surface 20 for the tool, the actuation surface 20 being surrounded by a "U"-shaped wall 21, as can be seen in particular in FIG. 16. Pressure for opening the spring can be exerted on the spring break contact 16 via the actuation surface 20, and the "U"-shaped wall 21 ensures a secure hold of the tool 18 on the spring break contact 16 since the "U"-shaped wall 21 provides a stop for the tool 18 on three sides.

As can be seen in FIGS. 14, 15 and 16, it is further provided for the opening in the "U"-shaped wall 21 to be on the side facing away from the cable insertion funnel 19. This configuration makes it possible to ensure that the tool 18 cannot cover the cable insertion region above the cable insertion funnel 19 in the event of slippage.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Connector 1
Base strip 2
Soldering pin 3
Plug-in region of the soldering pin 4
Soldering region of the soldering pin 5
First contact zone 6
Second contact zone 7
Circuit board 8
Soldering anchor, anchor shank 9
Soldering anchor, anchor head 10
Receiving means 11
Latching lug 12
Bending axis 13
Latching tab 14
Plug-in direction 15
Spring break contact 16
Housing 17
Tool 18
Cable insertion funnel 19
Actuation surface 20
"U"-shaped wall 21

The invention claimed is:

1. A plug connection device for connecting a cable having at least one core to a circuit board, the plug connection device comprising:

a connector which can be connected to the core of the cable; and a base strip which can be connected to the circuit board, the base strip comprising a soldering pin which can be electrically connected to the core of the cable in a plug-in region by placing the connector onto the base strip and which can be soldered to the circuit board in a soldering region in order to produce a conductive connection, wherein the soldering region of the soldering pin comprises a plurality of contact zones such that the base strip can be connected to the circuit board in different orientations, wherein the connector and the base strip can be mechanically and electrically contacted to one another in a predetermined plug-in direction in a plug connection, a latching tab and a latching lug, which can be latched to each other, being provided for mechanically fixing the plug connection device in the plugged-in state, and wherein the latching tab is attached at one side of the plug connection device, the latching tab having a bending axis that extends in parallel with the predetermined plug-in direction and about which the latching tab is configured to bend upon contact with the latching lug.

2. The plug connection device according to claim 1, wherein the contact zones are arranged at right angles to each other such that the base strip can be connected to the circuit board in two orientations which are at right angles to each other.

3. The plug connection device according to claim I, wherein the soldering pin has a "j" shape, wherein a bottom arch of the "J"-shaped soldering pin forms a first contact zone and a short shaft of the "J"-shaped soldering pin forms a second contact zone.

4. The plug connection device according to claim 3, wherein a long shaft of the "S"-shaped soldering pin forms the plug-in region.

5. The plug connection device according to claim 1, wherein the soldering pin has a "T" shape, wherein a first leg of the "T"-shaped soldering pin forms a first contact zone and wherein a second leg of the "T"-shaped soldering pin for: a second contact zone.

6. The plug connection device according to claim 5, wherein a third leg of the "T"-shaped soldering pin tires the plug-in region.

7. The plug connection device according to claim 1, wherein the plug-in region of the soldering pin projects through the base strip and is connectable to the core of the cable by the connector.

8. The plug connection device according to claim I, wherein the base strip can be connected to the circuit board by a soldering anchor.

9. The plug connection device according to claim 8, wherein the base strip provides a receiver for mounting the soldering anchor, the receiver being configured such that the soldering anchor can be connected to the base strip in different orientations.

10. The plug connection device according to claim I, wherein, the base strip includes both a vertical and a horizontal through-opening capable of functioning as a receiver for mounting the soldering anchor.

11. The plug connection device according to claim 1, wherein the latching lug is arranged and configured in such a way that it comes into contact with the latching tab only at the edge of the free end thereof during the plugging process.

12. The plug connection device according to claim 1, wherein an opening, arranged behind the latching tab, is provided for latching the latching lug to the latching tab.

13. The plug connection device according to claim 12, wherein the opening is open towards a deflected end of the latching tab.

14. The plug connection device according to claim 13, wherein an end of the opening which is opposite an open end thereof is rounded, at least in part, in the direction of the latching tab.

15. A plug connection device for connecting a cable having at least one core to a circuit board, the plug connection device comprising:

a connector which can be connected to the core of the cable;

a base strip which can be connected to the circuit hoard, the base strip comprising a soldering pin which can be electrically connected to the core of the cable in a plug-in region by placing the connector onto the base strip and which can be soldered to the circuit board in a soldering region in order to produce a conductive connection;

a housing;

a connecting spring disposed in the housing for electrically contacting the electrical conductor;

a spring break contact, which can be actuated by a tool, for opening the spring; and a cable insertion funnel for inserting the electrical conductor in the direction of the connecting spring, wherein the soldering region of the soldering pin comprises a plurality of contact zones such that the base strip can he connected to the circuit board in different orientations, wherein the spring break contact and the cable insertion funnel are adjacent to each other, and wherein the spring break contact includes an actuation surface for the tool which is surrounded by a U-shaped wall.

16. The plug connection device according to claim 15, wherein the opening in the U-shaped wall is provided on the side facing away from the cable insertion funnel.

17. The plug connection device according to claim 15, wherein the actuation direction of the spring break contact and the insertion direction of the cable insertion funnel are parallel with each other.

* * * * *